US008490811B2

(12) United States Patent
Erlich et al.

(10) Patent No.: US 8,490,811 B2
(45) Date of Patent: Jul. 23, 2013

(54) FOLDABLE POOL ACCESSORY STORAGE AND ORGANIZING CONTAINER

(75) Inventors: Guy Erlich, Monroe Township, NJ (US); Steven R. Myers, North Haledon, NJ (US)

(73) Assignee: Water Tech LLC, Est Brunswick, NJ (US)

( * ) Notice: Subject to any disclaimer, the term of this patent is extended or adjusted under 35 U.S.C. 154(b) by 179 days.

(21) Appl. No.: 13/068,642

(22) Filed: May 16, 2011

(65) Prior Publication Data

US 2012/0292313 A1 Nov. 22, 2012

(51) Int. Cl.
*B65D 25/00* (2006.01)

(52) U.S. Cl.
USPC ..... 220/9.2; 220/9.3; 220/9.4

(58) Field of Classification Search
USPC ..... 220/9.2, 9.3, 9.4, 482
See application file for complete search history.

(56) References Cited

U.S. PATENT DOCUMENTS

| | | | | |
|---|---|---|---|---|
| 1,284,579 | A * | 11/1918 | Brown | 220/485 |
| 5,971,188 | A * | 10/1999 | Kellogg et al. | 220/9.2 |
| 6,276,548 | B1 * | 8/2001 | Mitchell | 220/9.4 |
| 7,156,250 | B2 * | 1/2007 | Tillmann et al. | 220/9.2 |
| 2007/0039640 | A1 * | 2/2007 | Zheng | 135/126 |

* cited by examiner

*Primary Examiner* — Stephen Castellano
(74) *Attorney, Agent, or Firm* — Abelman, Frayne & Schwab

(57) ABSTRACT

A compactly foldable storage pouch includes a pair of resilient wire loops, a front fabric panel disposed over and covering the interior portion of the first wire loop, a rear fabric panel disposed over and covering the interior portion of the second wire loop, at least one sidewall fabric panel joining the wire loops, the side fabric panel circumscribing at least a portion of the periphery of the wire loops and defining an opening between the front and rear fabric panels and the opposing lateral ends of the sidewall fabric panel and a plurality of removeable lateral cross-members are positionable between the pair of wire loops to maintain the foldable pouch in an expanded configuration. Upon removal of the cross-members, adjacent wire loops can be twisted into a figure-8 configuration and folded over on itself to assume a compact, generally circular flat configuration for packaging, shipment and eventual storage by the user.

21 Claims, 5 Drawing Sheets

100
101
102
104
106
108
110
112
116
120
122
124
126
140 2
150
152
154
160
162
164
180
182
184

132
120
134
124
130

152
165
11
10
11
140 2
10
110
102
104
140 2
165
154

184
182
122
104
150
120
102

120
124
$142_1$
$142_1$
150
$140_1$
144
148
146
126
122

150
172
163
$142_1$
$140_1$
170
150
172
132

150
165
173
154
171
$140_2$
170
154
171
$142_2$
154

120
170
124
$142_2$
$140_2$
$142_2$
170
144
146
126
148
122

FIG. 12
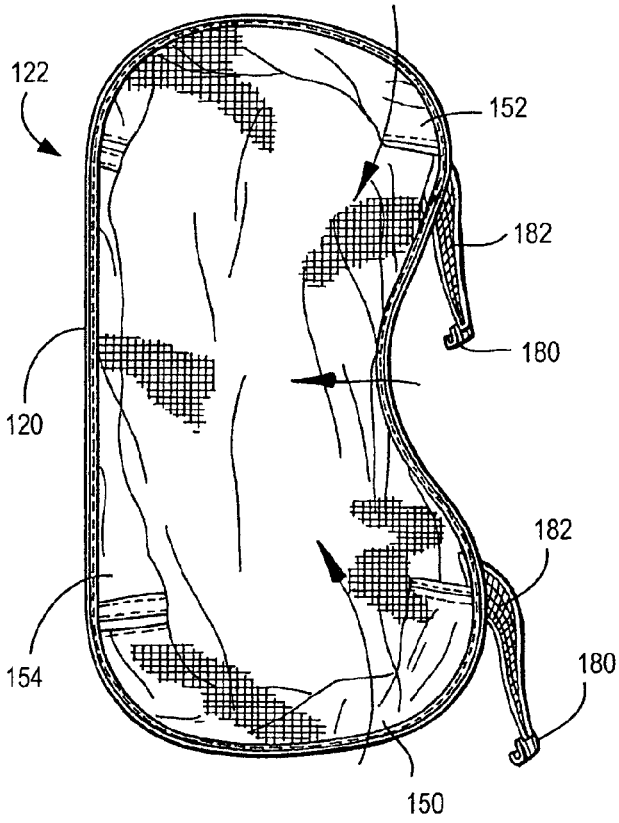
FIG. 13
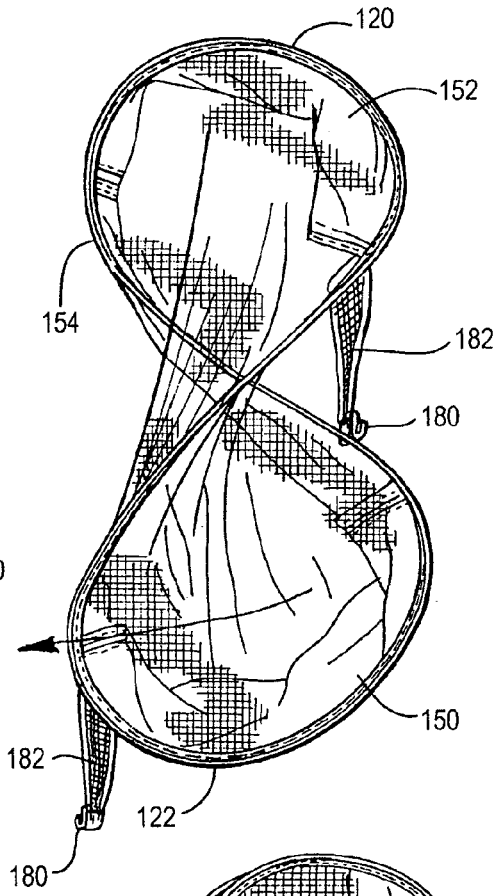
FIG. 14
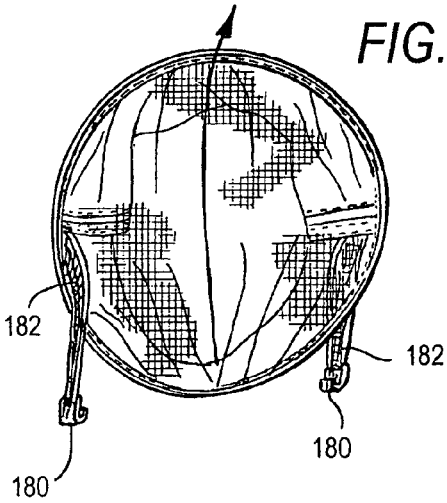
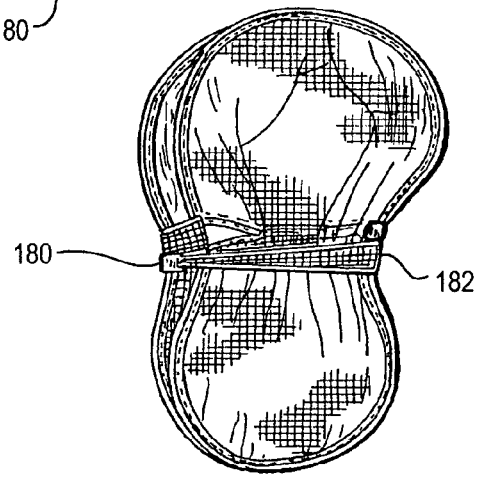
FIG. 15

FOLDABLE POOL ACCESSORY STORAGE AND ORGANIZING CONTAINER

CROSS-REFERENCE TO RELATED APPLICATION

This patent application contains subject matter related to commonly assigned U.S. design application Ser. No. 29/373,740, filed May 16, 2011, now U.S. Pat. No. D666,819, the content of which is incorporated by reference herein in its entirety.

FIELD OF INVENTION

The present invention relates to a portable container, and more specifically to a light-weight foldable storage container for organizing and storing toys and accessories associated with swimming pool, beach, lake, boating and/or other water activities.

BACKGROUND OF THE INVENTION

Homeowners having swimming pools, as well as boat owners, often have various accessories and toys that are used to enhance the owner's or user's pleasure while participating in water activities. Typically, pool, beach, lake and/or boating accessories can include inflatable rafts, kickboards, tubes, balls, life jackets, drink stands, and other well-known toys and flotation devices. The inexpensive manufacturing and mark-up costs for these types of toys and accessories are often an inducement for home owners and boaters to purchase a variety of flotation devices and accessories so that groups of people can enjoy themselves while participating in water activities. Although the accessories and flotation devices provide pleasure for those participating in water activities, when the water activities cease, the homeowner or boater often gathers and stores these accessories and flotation devices to prevent accidents and damage, as well as for aesthetic reasons.

Some homeowners will stack or pile the accessories in a particular location to tidy the pool or boat area. However, left unsecured a strong breeze can easily blow and scatter the flotation devices around the pool area, which can become frustrating as the homeowner will again have to pick up the toys and flotation devices and secure them so that they will not be scattered about the premises again. Alternatively, many homeowners will place the accessories and flotation devices inside a garage, pool storage shed or other storage area. However, most storage areas or garages are often crowded with other personal items which often make it difficult to retrieve the flotation devices at a later time, as well as subject them to possible damage by sharp objects.

Therefore, a need exists for a container or pouch-like device that is portable and light weight, and which can be used by home owners and boaters to safely store and make readily accessible various accessories and flotation devices for swimming pools and boats.

SUMMARY OF THE INVENTION

The disadvantages heretofore associated with the prior art are overcome by the present invention of a light-weight, compactly foldable pool accessory organizing and storage unit, which will also be referred to as a "pool pouch". The pool pouch of the present invention enables a homeowner, beach-goer, and/or boater to conveniently store and transport various types of pool, lake, boat-related accessories and flotation devices. The pool pouch is preferably fabricated with a light-weight, water-resistant fabric material that has elastic characteristics to enable the sides of the pool pouch to expand outward when filled with the various accessories and flotation devices. The light-weight material allows a user to easily transport the pouch and its contents to various places, for example, as between the home and the beach, to and from a boat, and from the pool side to a storage location (e.g., garage or storage shed). The fabric material preferably includes panels that are fabricated from an open mesh fabric material having a plurality of perforations which permits air to flow through the pool pouch and help dry any wet accessories or flotation devices, as well as enable excess water to drain out of the pouch.

The pool pouch of the present invention is provided with a frame structure including a pair of opposing wire loops which define and form the front and rear sides of the pouch. In an embodiment, each of the pair of wire loops is generally rectangular in shape. In one embodiment, each of the pair of wire loops is defined by opposing curvilinear ends joined by upper and lower sections that are generally straight or gently curved toward each other. Each wire loop further includes the water-resistant fabric material, such as a mesh fabric material and/or a non-perforated fabric material adjoined between the interior portions of each wire loop to form a front panel and a rear panel. The water-resistant fabric is also provided along the opposing sides and bottom of the pool pouch to thereby define an interior space between the front, rear, bottom and opposing side panels. A major portion of the top of the pool pouch is an opening to allow easy access of the interior of the pouch.

A plurality of removable rigid cross-members extend laterally between the pair of opposing wire loops to maintain the pouch in an expanded (e.g., box-like) configuration. When a user removes the cross-members from their lateral positions, the pair of wire loops can be stacked adjacently and folded into a collapsed configuration for storage.

In a preferred embodiment the foldable pouch comprises a pair of flexible and resilient wire loops; a front fabric panel disposed over and covering at least an interior portion of a first of the pair of wire loops; a rear fabric panel disposed over and covering at least an interior portion of the second of the pair of wire loops; at least one sidewall fabric panel coupled between the pair of wire loops, the at least one side fabric panel circumscribing along a least a portion of the periphery of the wire loop and defining an opening between the front and rear fabric materials and opposing lateral ends of the at least one sidewall fabric material; a plurality of lateral rigid cross-members configured to be removably positioned between the pair of wire loops to maintain the foldable pouch in an expanded configuration, and wherein the wire loops are stacked adjacently such that the foldable pouch is in a collapsed configuration when the plurality of lateral cross-members are removed therebetween.

In one aspect, the front and rear fabric panels are fabricated from a water-resistant mesh fabric. Further, at least one sidewall which is formed between the front and rear panels can be fabricated from a water-resistant fabric. The at least one sidewall can be a single sidewall panel that is formed by contiguous portions or sections, e.g., the right section, bottom section and a left section. Alternatively, the at least one sidewall can be formed by two or more sidewall panels, e.g., opposing side panels and a bottom panel therebetween. In one embodiment, the at least one sidewall includes a plurality of fabric channels that extend laterally between the pair of wire loops, each channel being positioned and configured to receive a respective removable cross-member to maintain the pouch in the expanded configuration.

In one aspect, the pair of wire loops is fabricated from stainless-steel. In yet another aspect, the pair of wire loops has a curvilinear configuration without sharp bends or corners in order to avoid tearing the surrounding fabric and injuring users.

In one embodiment, the at least one sidewall comprises a pair of opposing sidewall panels each having an upper and lower end positioned laterally between the pair of wire loops, and a bottom fabric panel positioned between the lateral lower ends of the opposing sidewall panels and the pair of wire loops. In one aspect, opposing edges of the sidewall panels and the bottom panel respectively circumscribe adjacent portions of the wire loops in close-fitting relation and are fastened thereabout by stitching.

In one embodiment, the front and rear fabric panels and the bottom panel are fabricated from a water-resistant mesh material through which the stored contents of the unit can readily be seen, and the opposing sidewall panels are fabricated from a water-resistant material. In one aspect, an opening is defined between opposing top portions of the pair of wire loops and the lateral upper ends of the opposing sidewall panels.

In one embodiment, a first pair of spaced-apart fabric channels is formed laterally along the bottom panel and a second pair of spaced-apart fabric channels is formed laterally along the upper ends of the opposing sidewall panels, the first and second pair of spaced-apart fabric channels being configured to removably receive the lateral cross-members. In one aspect, one end of the first and second pair of spaced-apart fabric channels is closed and the opposing end of the first and second pair of spaced-apart fabric channels includes a first fastener for selectively opening and closing the channels to permit insertion and removal of the lateral cross-members. In one embodiment, the first fastener is a hook-and-loop fastener.

In one embodiment, the top portions of the pair of wire loops are curved downwardly towards the bottom panel. In yet another embodiment, the lateral cross-members are fabricated from a rigid water-resistant material.

In yet another aspect, the foldable pouch includes a closure for closing the opening. In one aspect, the closure comprises at least one of a strap and a flexible fabric that spans the opening.

In one embodiment, the foldable pouch comprises hanging means for hanging the foldable pouch above ground. In one aspect, the suspension devices comprise at least one suspension hook coupled to one of the wire loops. The hook can be attached to a flexible suspension strap that in turn is secured to the loop, as by sewing.

In yet another embodiment, when the foldable pouch is in the collapsed configuration, the rigid lateral cross-members are removed from between the pair of wire loops, and the pair of wire loops are in superposed touching relation and are twisted first in a figure-eight configuration and then folded one over the other to assume a generally circular, flattened configuration that is less than half of the size of the extended storage unit. The compactly folded unit can be maintained by one or more of the suspension hooks.

BRIEF DESCRIPTION OF THE DRAWINGS

Further advantages and features of the present invention will become apparent from the detailed description of a preferred embodiment of the invention with reference to the accompanying drawings in which:

FIGS. 12-15 depict the foldable pool pouch of FIG. 1 in various configurations so as to illustrate the folding of the pouch from an expanded configuration to a collapsed configuration for storage.

Figures 1, 6:
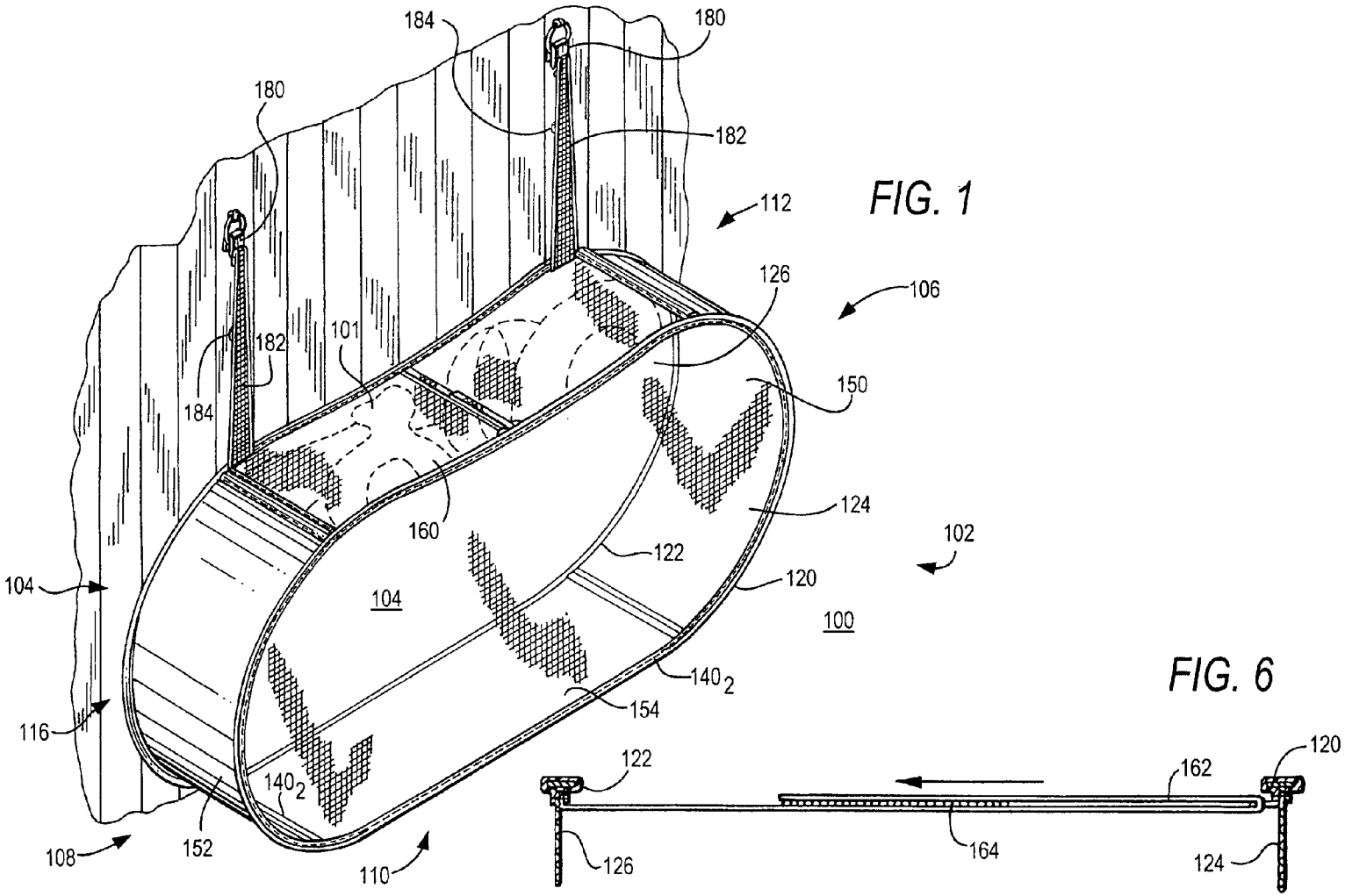
FIG. 1 is a top, front perspective view of the foldable pool accessory organizing pouch of the present invention.
FIG. 6 is an elevated side view of a top suspension strap and hook fastener of the pouch taken along lines 6-6 of FIG. 2.

To facilitate an understanding of the invention, identical reference numerals have been used when appropriate, to designate the same or similar elements that are common to the figures. Further, unless stated otherwise, the features shown in the figures are not drawn to scale, but are shown for illustrative purposes only.

DETAILED DESCRIPTION OF THE INVENTION

Referring to FIG. 1, a preferred embodiment of the foldable pool accessory organizing and storage pouch 100 is illustratively shown. As shown in FIG. 1, a foldable pool pouch 100 having an extended curvilinear shape, somewhat resembling an acoustic guitar, defines an interior volume to store pool accessories and/or floatation devices 101 (shown in phantom in FIG. 1), although such configuration is not considered limiting. As will be apparent, other curvilinear shapes, including oval, elliptical, or even round, can be used. An example of an illustrative configuration of the foldable pool pouch can be found in commonly assigned and co-filed US design application Ser. No. 29/373,740, now U.S. Pat. No. D666,819, the contents of which is incorporated by reference in its entirety. In any embodiment, the configuration illustrated in the drawings has the advantages of easy access to the items on the interior bottom of the unit and the ability to compactly fold the unit for shipping, warehousing, and storage by the eventual owner.

The pool pouch 100 includes a front portion 102, an opposing rear portion 104, a first side portion 106, an opposing second side portion 108, a bottom portion 110, and a top portion 112 collectively forming the pouch 100. In one embodiment, the pool pouch 100 has a length of approximately sixty inches, a height of thirty inches, and a depth of twelve inches, although such dimensions are not to be considered limiting, as other pool pouch shapes (e.g., oval, elliptical, pentagonal and the like) and dimensions are comprehended by the present invention. As noted above, shapes including corners, e.g., 90° bends are less favored.

The pool pouch 100 comprises a collapsible/expandable or otherwise foldable frame 116 which includes a first wire loop 120, a second wire loop 122, and a plurality of cross-members 140 spaced laterally between the first and second wire loops 120 and 122. The first and second wire loops 120 and 122 are preferably fabricated from a resilient flat metal wire or strap 130 (FIG. 7), each wire 130 having opposing ends that are joined together to form a wire loop. The opposing ends of each strap/wire 130 can be joined together end-to-end using a connector (e.g., crimping connector), by welding or any other well-known fastening or bonding technique to safely secure the opposing ends of the wire 130 together. The wire can be metal or plastic. Preferably, the wires 130 of the first and second wire loops 121, 122 are fabricated from light-weight stainless steel to resist corrosion from exposure to the wet/humid environments. Alternatively, the wires 130 of the first and second wire loops 120, 122 can be fabricated from other well-known metal alloys resistant to corrosion, as well as flexible strips of polyvinylchloride (PVC) among other water-impermeable polymeric materials. Similarly, where connectors (not shown) are used to join the ends of the wires 130 of the loops 120 and 122 together, the connectors are also preferably fabricated from corrosion-resistant materials, such as stainless steel, PVC, or the like.

Figure 3:
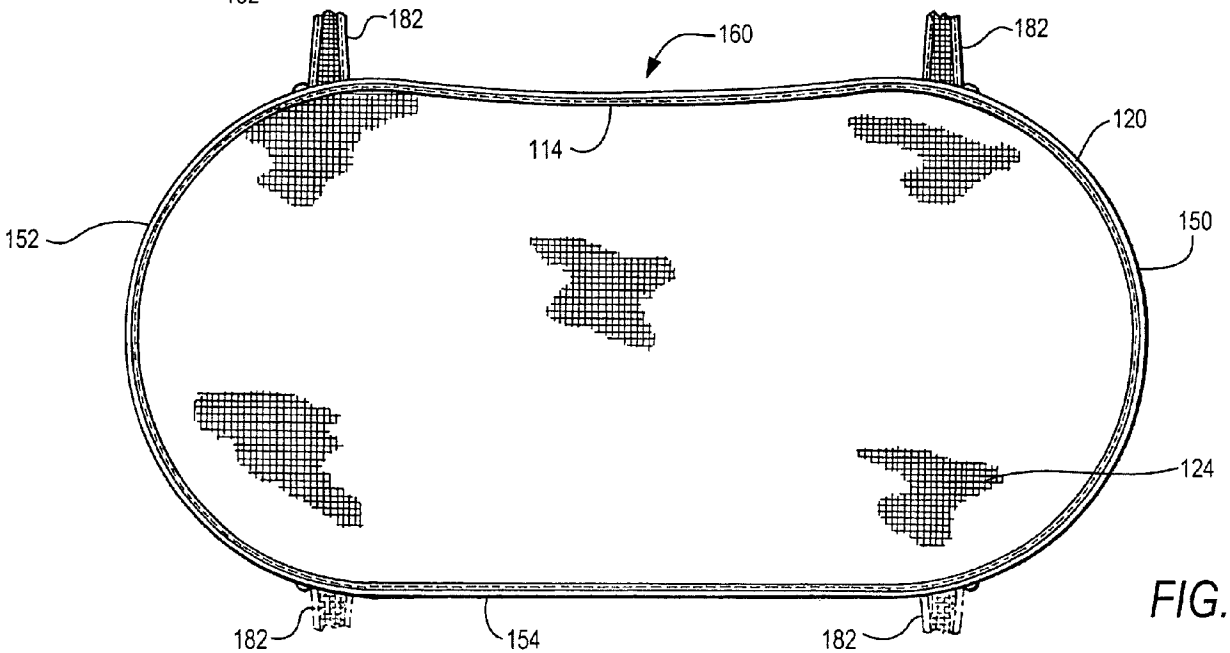
FIG. 3 is an elevated front view of the foldable pool pouch shown in FIG. 1, the rear view being a mirror image thereof.

The pair of wire loops 120 and 122 are preferably sized the same to define a generally elongated curvilinear shape having a substantially planar bottom surface 110 with respect to the ground, curved vertical side portions 106, 108, and a somewhat downwardly curvilinear top portion 104, as best shown in FIG. 3. The first and second wire loops 120, 122 are maintained in spaced-apart relation to define the storage volume by the plurality of rigid cross members 140, which are removably positioned laterally between the first and second loops 120 and 122.

In a preferred embodiment, a water-resistant mesh panel 124 is positioned over the first wire loop 120 and is attached on the periphery of the wire loop 120 such that the wire loop 120 is covered by the mesh fabric material 124. Likewise, a second rear side mesh fabric panel 126 is positioned over the second wire loop 122 and attached at its edge about the periphery of the wire loop 122 such that the wire loop 122 is covered with the fabric material 126. Preferably, the mesh panels 124 and 126 are sized slightly greater than the diameter or cross-sectional dimensions of the wire loops 120 and 122 to provide slack and expandability of the panel 124 and 126.

The mesh fabric panels 124 and 126 can be fabricated from a polyester or nylon mesh fabric, among other readily available water-resistant materials. Preferably, the perforations in the mesh-like fabric materials 124 and 126 have a dimension of ⅛ inch, although such dimension should not be considered limiting. For example, the perforations can illustratively be in the range of 1/16 to ½ inches in diameter.

Figures 4, 5, 7:
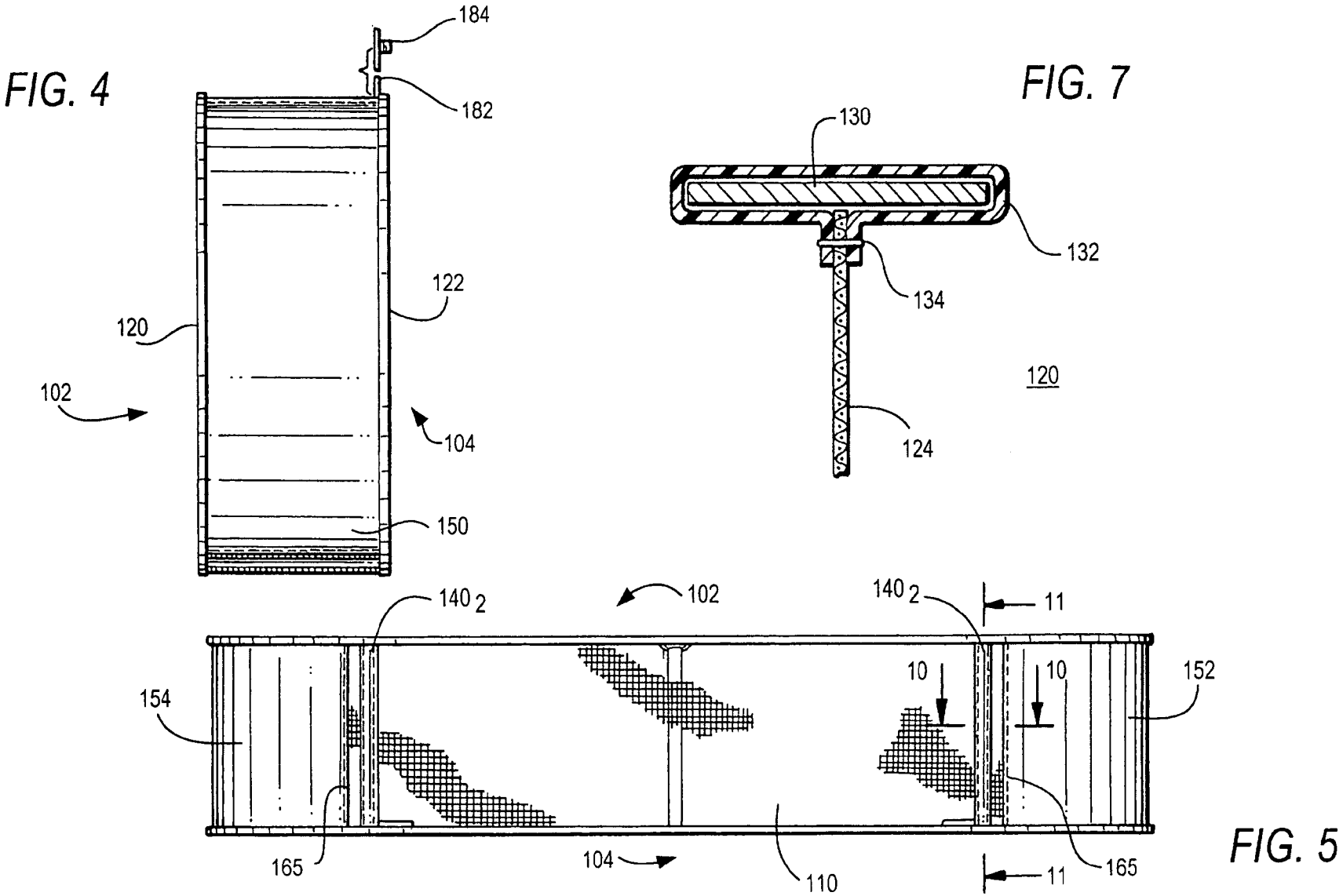
FIG. 4 is an elevated right side view of the foldable pool pouch of FIG. 1, the opposing left side view being a mirror image thereof.
FIG. 5 is a bottom view of the foldable pool pouch of FIG. 1.
FIG. 7 is an exploded cross-sectional view of a portion of a wire loop and mesh fabric cover taken along lines 7-7 of FIG. 2.

Referring to FIG. 7, preferably a water-resistant or water-impermeable fabric or ribbon sheathing 132, e.g., polyester, nylon and the like, is wrapped around or otherwise circumscribes, i.e., sheaths, the lengths of each wire loop 130. The ribbon sheathing 132 covers and protects the outer surface of the wire loops 120 and 122, as well as helps secure the peripheral edging of the mesh materials 124 and 124 with respect to the wires 130 of wire loops 120 and 122. As shown in FIG. 7, the peripheral edge of the mesh fabric 124 includes stitches 134 between the opposing edges of the ribbon sheathing 132. The stitching 134 is provided along the entire interior of each loop between the edge of the mesh fabric materials and the edges of the ribbon sheathing 132.

Alternatively, the edges of the mesh fabric materials 124 and 126 can also be wrapped around the outer surface of the respective wire metal bands 130 of the first and second wire loops 120 and 122 and secured with stitching 134 along the interior of the wire loops to secure the perimeters of the mesh fabric panels 124 and 126 to their respective wire loops 120, 122. Further, the ribbon sheathing 132 can be positioned over and cover the mesh fabric wrapping in a similar manner as shown in FIG. 7 to provide increased durability. Moreover, the periphery of the mesh fabric panels 124 and 126 can be glued or otherwise bonded or secured around the outer surface of the wire loops to form a sleeve 120, 122 in any other known manner.

The front portion 102 and rear portion 104 of the pool pouch 100 are respectively formed by the combination of the first wire loop 120 and the mesh fabric 124, and the combination of the second wire loop 122 and the mesh fabric 126. The front and rear portions 102, 104 are spaced apart a distance, e.g., 10-16 inches, and are secured together by at least one sidewall, such as a pair of flexible opposing side panels 150 and 152, which are preferably fabricated from the same water-resistant or water-impermeable fabric material forming the mesh fabric 124 and 126 of the front and rear portions 102, 104 of the pool pouch 100. The at least one sidewall can be a single sidewall illustratively having various location identifiers or sections, e.g., a right section 150, bottom section 154 and left section 152. A person of ordinary skill in the art will appreciate that the number of location identifiers (e.g., sections) is not considered limiting, and the single sidewall can be fabricated from one or more types of fabric materials. Alternatively, the at least one sidewall can be formed by two or more contiguous panels. In an embodiment, the at least one sidewall is illustratively formed by three panels, i.e., opposing side panels 150 and 152, and bottom panel 154, although the number of panels is not to be considered limiting. Preferably, the opposing side panels (or sections) 150 and 152 are fabricated from a non-perforated or non-mesh polyester or nylon fabric material to prevent the ends of the accessories or flotation devices from puncturing, tearing and/or poking therethrough. Alternatively, the side panels 150 and 152 can be fabricated from a high-tensile strength mesh fabric material that is resistant to such damage. Additionally, the bottom panel 154 is provided along the bottom of the pool pouch 100 extending between and joining the first and second wire loops 120 and 122 and the lower lateral (i.e., transverse) edges of the side panels 150, 152. Preferably the bottom panel (or section) 154 is fabricated from the same mesh fabric material used to form the front and rear panels, although the use of such mesh material is not limiting. For sake of clarity, the reference number designations 150, 152 and 154 are hereinafter used to refer to the right panel, the left panel and the bottom panel, respectively, which collectively define the continuous sidewall extending between and joining the front panel 102 and rear panel 104. However, a person of ordinary skill in the art will appreciate that where the at least one sidewall is formed of a single sidewall, the reference number designations 150, 152 and 154, respectively, represent right, left, and bottom sections or portions of the sidewall which extends between and joins the front panel 102 and rear panel 104.

The side panels 150 and 152, as well as the bottom panel 154 are attached along opposing peripheral edges to the respective first and second wire loops 120, 122 in a similar manner to that by which the fabric mesh materials 124, 126 are attached to the first and second wire loops 120, 122. For example, the ribbon sheathing or sleeve 132 is stitched 134 over the wire loop 130 proximate to where the front mesh fabric 124 is adjacent to the front lateral sides of the side panels 150 and 152. Likewise, the ribbon sheathing 132 is stitched 134 over the wire loop 130 proximate to where the rear mesh fabric 126 is adjacent to the rear lateral sides of the side panels 150 and 152. Similarly, the ribbon sheathing 132 can cover and be stitched over the wires 130 proximate to where the opposing lateral edges of the bottom mesh panel 154 are adjacent to the front and rear mesh panels 124 and 126.

Referring to FIGS. 1-4, the opposing side fabric panels 150 and 152 preferably extend from the bottom portion 110 to the top portion 112 of the pool pouch 100, although such construction and dimension are not to be considered as being limiting. Further, the widths of the opposing side fabric panels 150, 152 and the bottom panel 154 are commensurate with the widths of the lateral cross-members 140, e.g., twelve inches. The top lateral edges of the opposing side panels 150 and 152, as well as the inner surfaces of the mesh fabric materials 124 and 126 that are attached to the wire loops 120 and 122 define a top opening 160, which is dimensioned to insert and remove the pool accessories and flotation devices in a convenient manner. In the embodiment where the at least one sidewall is formed from a single web of material, the top opening 160 is illustratively formed in part by the upper end (top lateral) edges of the right and left sections 150 and 152 of the sidewall.

Figure 2:
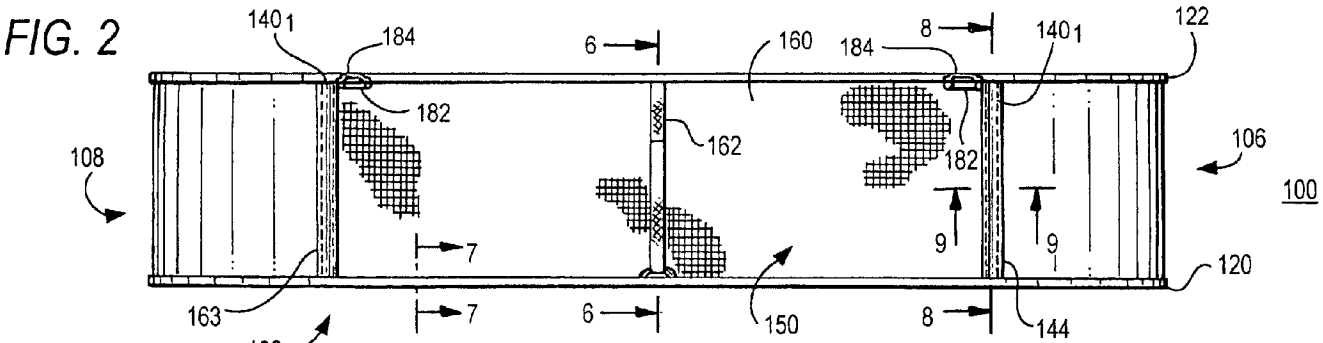
FIG. 2 is a top plan view of the foldable pool pouch of FIG. 1.

As shown in FIGS. 1 and 2, a strap 162 with a fastener 164, e.g., hook-and-loop fastener is preferably mounted (e.g., stitched) laterally across the elongated top opening 160 to serve as a handle to enable a user to transport the pool pouch 100. Further, the strap 162 generally restrains the accessories within the interior of the pouch 100 and prevents them from falling out through the elongated top opening 160. A person of ordinary skill in the art will appreciate that a plurality of straps 162 with fasteners 164 can be provided laterally across the elongated top opening 160 to provide additional restraints. Alternatively, an elongated flap cover (not shown) can be attached along the top portion 112 of one of the loops (e.g., the rear loop 122) to close the top opening 150. In this embodiment, the elongated cover can be folded over the top 112 to cover the opening 16 and one or more fasteners can be provided to secure the cover in position.

Referring to FIGS. 1 and 5, a first pair of cross members $\mathbf{140}_1$ is preferably positioned laterally along the bottom portion 110 between the first and second wire loops 120 and 122 to act as rigid stretchers to better define the storage volume. Likewise, referring to FIGS. 1 and 2, a second pair of cross members $\mathbf{140}_2$ is positioned laterally at opposing ends along the top 112 between the first and second wire loops 120 and 122 of the pool pouch 100. The cross-members $\mathbf{140}_1$ and $\mathbf{140}_2$ (collectively cross-members 140) can be fabricated from a polyvinyl chloride (PVC) tubing or any other substantially rigid, lightweight and water-impermeable material. In a preferred embodiment, the cross-members 140 are elongated circular tubes having a ½ inch outer diameter and a length of 12 inches, although such dimensions are not considered limiting.

Figures 8, 9, 10, 11:
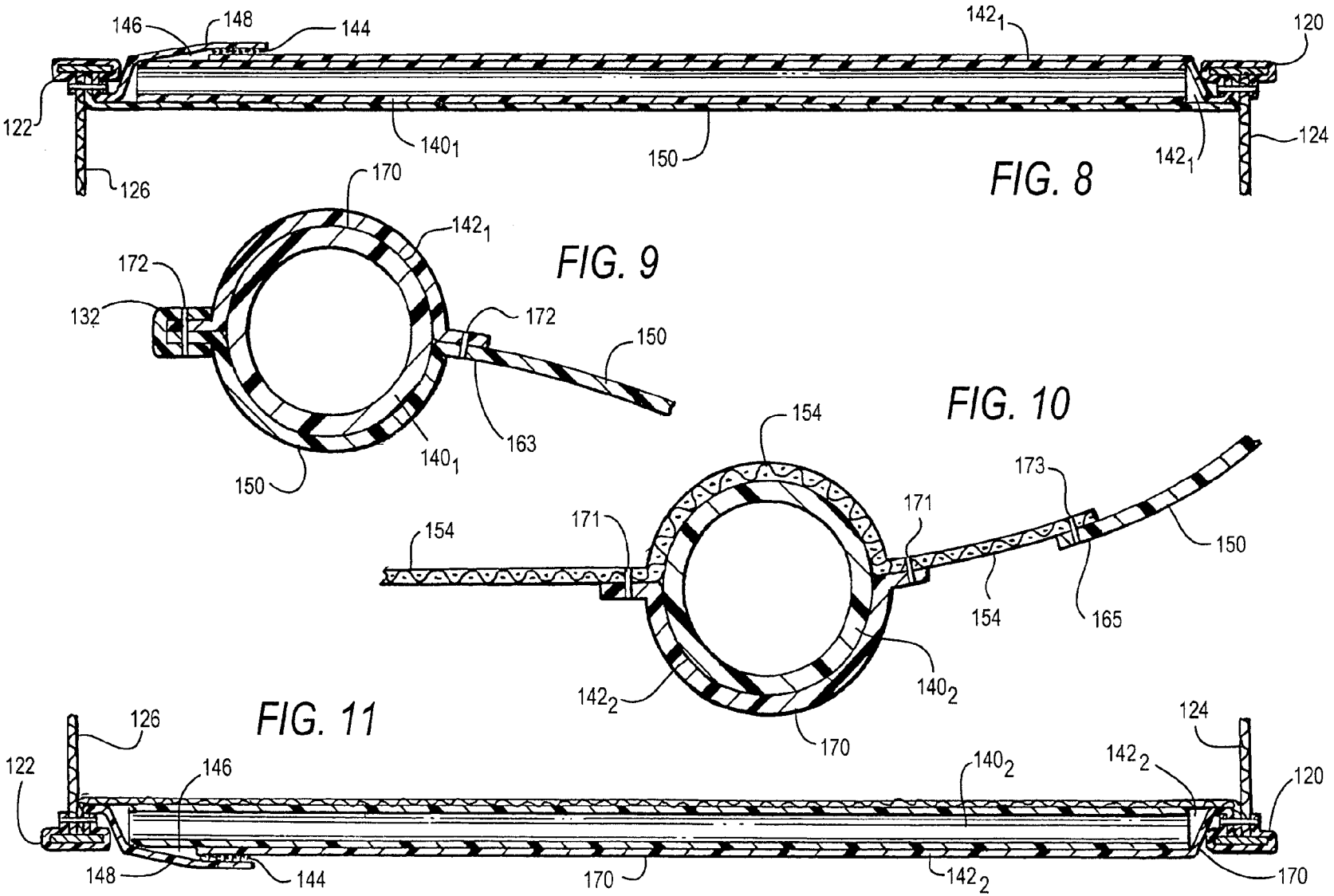
FIG. 8 is a cross-sectional view of a bottom channel and a removable lateral cross-member taken along lines 8-8 of FIG. 2.
FIG. 9 is a cross-sectional view of the bottom channel and the removable lateral cross-member taken along lines 9-9 of FIG. 2.
FIG. 10 is a cross-sectional view of an upper channel and a removable lateral cross-member taken along lines 10-10 of FIG. 5.
FIG. 11 is a cross-sectional view of the upper channel and the removable lateral cross-member taken along lines 11-11 of FIG. 5.

Referring now to FIGS. 2, 8 and 9, each upper cross member $\mathbf{140}_1$ is removably inserted into a corresponding channel $\mathbf{142}_1$ which extends laterally along the upper edge 163 of the opposing side panels 150, 152.

Referring to FIG. 9, a fabric strip 170 is disposed over and secured to the lateral edge of the side panel 150 to form the channel $\mathbf{142}_1$ therebetween. Stitching 172 is provided along each lateral edge of the fabric strip 170 to secure it to the upper edge 163 of the side panel 150. Preferably, ribbon sheathing 132 is also provided along the outermost edge of the channel $\mathbf{142}_1$ to provide additional support and durability, as well as aesthetics for the top opening 160 of the pool pouch 100.

Referring to FIG. 8, one end (e.g., the right end) of the channel 142 is illustratively closed by stitching the corresponding right end of the fabric strip 170 to the first wire loop 120 in a similar manner as discussed above with respect to attaching the mesh fabric 124 to the wire loop 120. Referring to the opposing (i.e., left) end of the channel $\mathbf{142}_1$, the corresponding left end of the fabric strip 170 is not stitched to the wire loop 122 and remains a free end to define an opening 146 between the upper edge 163 of the side panel 150 and the second wire loop 122. An elongated channel flap 148 is provided such that a first end is stitched to the second wire loop 122 and an opposing second end of the channel flap 148 is a free end that includes a fastener 144, such as a hook-and-loop fastener to close and secure the channel opening 146 to prevent the cross member $\mathbf{140}_1$ from coming out of the channel $\mathbf{142}_1$ during use.

Referring now to FIGS. 5, 10 and 11, the lateral cross members $\mathbf{140}_2$ are inserted into channels $\mathbf{142}_2$ formed laterally between the bottom portion 110 of the front and rear wire loops 120 and 122. Referring to FIG. 10, the lower lateral edge 165 of the right side panel 150 is stitched at 173 to an adjacent lateral edge of the bottom panel 154. Preferably the bottom panel 154 is fabricated from a mesh fabric material to permit excess water to drip out of the pouch 100. A fabric strip 170 is stitched at 171 along both sides of the strip to form a channel $\mathbf{142}_2$ between the interior surface of the fabric strip 170 and the adjacent surface of the bottom panel 154. The channel $\mathbf{142}_2$ is sized to receive the tubular cross member $\mathbf{140}_2$, as discussed above with respect to the upper cross members $\mathbf{140}_1$ and corresponding channels $\mathbf{142}_1$. A second lower channel $\mathbf{140}_2$ is provided on the opposite end of the bottom panel 154 near the left side panel 152 in a manner similar to that shown in FIG. 10. As will be apparent to one of ordinary skill in the art, the number, placement and methods of securing the lateral cross-members in position can be varied.

Referring now to FIG. 11, one end (e.g., the right end) of the channel $\mathbf{140}_2$ is closed by stitching the corresponding end of the lateral fabric strip 170 to the first wire loop 120 in a similar manner as discussed above with respect to the upper channel $\mathbf{142}_1$ in FIG. 8. On the left side of the channel $\mathbf{142}_2$ the end of the fabric strip 170 is not stitched to the wire loop 122 and an opening 146 is defined there between to enable the cross member $\mathbf{140}_2$ to be inserted and removed from the channel $\mathbf{142}_2$. As described above with respect to the upper channel $\mathbf{142}_1$, a channel flap 148 is provided in which one end is stitched to the second wire loop $\mathbf{122}_2$ and the opposing end of the channel flap 148 can be secured to the outer surface of the left side of the fabric strip 170 by a fastener, such as a hook-and-loop fastener, a clip, a snap fastener and/or buckle, among other well known fasteners. As discussed in further detail below, with respect to FIGS. 12-15, the insertion of the cross members laterally between the first and second wire loops 120 and 122 maintains the pool pouch 100 in an expanded configuration. Conversely, by removing the lateral cross members 140 from the respective channels 142, the pool pouch 100 can be folded and collapsed as will be described in further detail below.

Referring now to the drawing series of FIGS. 12-15, the pool pouch 100 is illustratively shown being folded and collapsed from an expanded configuration to a compact and easily storable configuration. In FIG. 12, the pool pouch 100 is illustratively shown with the lateral cross-members 140 removed from the respective cross member channels 142 and the first and second wire loops 120, 122 stacked or positioned adjacent to each other. Preferably, after removal, the cross-members 140 are placed within the interior of the pouch so as not to become lost. In this partially collapsed configuration, the side panels 150, 152 as well as the bottom panel 154 are collapsed and folded inwardly towards the interior of the pouch 100.

Referring to FIG. 13, the right side of the pouch is twisted 180 degrees with respect to the left side such that the pair of wire loops 120, 122 criss-cross approximately mid-way between the opposing ends of the pool pouch to form a "figure 8" configuration. Referring to FIG. 14, the two circular portions of the "figure 8" configuration of FIG. 13 are folded along the middle to adjacent positions with respect to each other to form a generally circular-shaped configuration. Accordingly, the circular configuration of the collapsed pool pouch (shown in FIG. 14) is approximately one half of, or less than the size of the pool pouch 100 in its fully expanded configuration (shown in FIG. 1).

Referring to FIGS. 1 and 15, at least one elongated strap 182 having a fastener 180 at a distal end is attached to the rear wire loop 122 at an opposing proximal end. The strap 182 can be used illustratively to hang the pool pouch 100 as shown in FIG. 1, as well as to secure the pool pouch 100 in its folded collapsed configuration as shown in FIG. 15.

Preferably, the pool pouch 100 includes a pair of vertically depending straps 182 each strap having a first end attached, e.g., sewn, to the rear wire loop 122, and a free distal end having a fastener 180 provided thereon as illustrated in FIG. 1. Each of the vertical straps 182 is preferably fabricated from the same polyester or nylon material as used to form the mesh or panels (e.g., panels 124, 126, 150, 152, 154) of the pool pouch 100. As illustratively shown in the drawings, the vertical straps 182 are fabricated from the mesh fabric material, although such fabric is not considered limiting, as a rope or other fabric strap is contemplated by the present invention. In one embodiment, the fastener 180 at the distal end of each vertical strap 182 is a hook, which can be used to hang the pool pouch 100 from a vertical structure such as a fence as shown in FIG. 1. As illustratively shown in FIG. 1, the hook 180 can be fastened to a loop, such as an O-ring or D-ring attached to the vertical structure (e.g., fence). Alternatively, the hook can pass through the D-ring and hook to the vertical strap 182 itself beneath the D-ring.

In one embodiment, a loop strap or band 184 extends laterally along the backside of the vertical straps 182, as shown in FIGS. 1, 2 and 4. Each loop strap 184 illustratively extends perpendicular to the longitudinal axis of the corresponding vertical strap 182, however, such configuration is not considered limiting. In this manner, the hook 180 and distal end of the vertical strap 182 can pass over a horizontal cross-member such as a top rail of a fence and extend downwardly and be fastened (e.g., hooked) to the loop strap 184. Although the loop straps 184 are illustratively shown attached to the backsides of the vertical straps 182, a person of ordinary skill in the art will appreciate that the loop straps 184 can be attached (e.g., sewn) along any rear surface area of the rear panel 104. For example, the loop straps 184 can be sewn along the top portion of the rear wire loop 122 adjacent to where the first end of the vertical strap 182 is attached to the wire loop 122. Alternatively, the loop straps 184 can be sewn along the bottom portion of the rear wire loop 122. In one embodiment, a plurality of loop straps 184 are provided for each vertical strap 182 to permit the user to select alternative loop straps for hanging the pouch 100 of the present invention.

Referring to FIG. 3, as shown in phantom, one or more vertical straps 182 can optionally also be secured to the bottom of the rear wire loop 122. The bottom vertical straps 182 can include a fastener 180 such as a hook, D-ring, or other fastener in the same manner as described above with respect to the vertical straps 182 provided on the top of the wire loop 122. A person of ordinary skill in the art will appreciate that each bottom vertical strap 182 can also have one or more corresponding loop straps 184, as described above with respect to the vertical straps 182 provided on the top of the wire loop 122. The one or more bottom vertical straps 182 are useful for securing the bottom portion of the pool pouch 100 to a support, such as a fence. A person of ordinary skill in the art will appreciate that alternative fasteners can be used for securing the vertical straps 182 to a structure, including tying the straps to the structure.

Referring now to FIG. 15, the one or more straps 182 can be used to wrap around the folded pool pouch and be clipped to a wire loop 120 or 122. A person of ordinary skill in the art will appreciate that the fasteners 180 can be provided, such as D-rings, clips, buckles or any other fasteners suitable for hanging the pool pouch above ground and/or securing the pouch in its folded configuration for storage as shown in FIG. 15.

The present invention provides a storage container or pouch for storing accessories, toys and floatation devices associated with water activities, such as those used at a swimming pool, a lake, a river, a beach or with a boat. Advantageously, the pouch of the present invention is fabricated from combination of durable, lightweight water-permeable and water-impermeable materials that enables a user to readily transport and store such toys and floatation devices with ease and without worrying about loss of the contents.

Preferably, the pouch includes mesh fabric portions that allow air to flow and water to escape from the pouch to allow the contents to dry quickly and to prevent mildew and mold, as well as keep the storage area dry. The mesh fabric material is expandable such that large and numerous items can be stored in the pouch. When the pouch is not in use, it can be hung from a vertical structure, or it can be folded and collapsed into a smaller footprint for storage.

While the foregoing is directed to embodiments of the present invention, other and further embodiments of the invention will be apparent to, and can be devised by those of ordinary skill in the art based on this description without departing from the basic scope of the invention, the scope of which is to be determined by the claims that follow.

We claim:

1. A foldable collapsible storage pouch comprising:

a pair of flexible loops;

each flexible loop having a web of fabric of predetermined shape secured about its periphery to the loop to define, respectively, front and rear panels;

a sidewall formed of a web of fabric having opposing longitudinal edges and opposing transverse ends, each of the longitudinal edges being secured to and circumscribing a corresponding portion of the periphery of the front and rear panels, the opposing transverse ends of the fabric sidewall positioned to define an opening for accessing an interior space between the front and rear panels and the sidewall;

a plurality of spaced-apart transverse tubular channels joined to a surface of the sidewall and extending between the front and rear panels;

a plurality of rigid cross-members, each cross-member configured and dimensioned to be inserted and contained in one of the plurality of transverse channels to maintain the foldable pouch in an expanded configuration; and wherein the flexible loops are aligned with each other when the plurality of cross-members are removed from the transverse channels and foldable pouch is in a collapsed configuration.

2. The foldable pouch of claim 1, wherein the front and rear panels are formed from a water-permeable mesh fabric.

3. The foldable pouch of claim 1, wherein the sidewall is a water-resistant fabric.

4. The foldable pouch of claim 1, wherein the transverse channels are configured to maintain the removable cross-member in the channel.

5. The foldable pouch of claim 1, wherein the flexible loops are fabricated from stainless steel.

6. The foldable pouch of claim 1, wherein the flexible loops are generally rectangular in shape.

7. The foldable pouch of claim 6, wherein opposing end portions of the pair of flexible loops between top and bottom portions are curvilinear.

8. The foldable pouch of claim 1, wherein the sidewall comprises a pair of opposing sidewall portions, each of the pair of sidewall portions having an upper end defining one side of the opening.

9. The foldable pouch of claim 8, wherein the sidewall further comprises an intermediate bottom portion having opposing lateral ends extending between the front and rear panels, each lateral end of the bottom portion being joined to an adjacent lateral lower end of one of the opposing sidewall portions.

10. The foldable pouch of claim 8, wherein the opening is defined between opposing top portions of the pair of flexible loops and the upper ends of the pair of opposing sidewall portions.

11. The foldable pouch of claim 9, wherein the front and rear fabric panels and the bottom portion are fabricated from a water-permeable mesh material, and the pair of sidewall portions are fabricated from a water-impermeable material.

12. The foldable pouch of claim 9, wherein a first pair of spaced-apart transverse tubular channels are formed in the bottom portion and a second pair of spaced-apart transverse tubular channels are formed laterally along the upper ends of the opposing sidewall portions, the first and second pair of spaced-apart transverse tubular channels being configured to removably receive the cross-members.

13. The foldable pouch of claim 12, wherein one end of the first and second pair of spaced-apart transverse tubular channels is closed and the opposing end of the first and second pair of spaced-apart transverse tubular channels includes a first channel fastener for selectively opening and closing the channels to permit insertion and removal of the cross-members.

14. The foldable pouch of claim 13, wherein the first channel fastener is a hook-and-loop fastener.

15. The foldable pouch of claim 1, wherein the cross-members are fabricated from a water-resistant material.

16. The foldable pouch of claim 1, further comprising one or more closures for closing the opening.

17. The foldable pouch of claim 16, wherein the one or more closures comprise at least one of a strap and a flap cover.

18. The foldable pouch of claim 1, further comprising one or more supports for attaching the foldable pouch to a supporting structure.

19. The foldable pouch of claim 18, wherein the one or more supports comprises at least one hook coupled to one of the flexible loops.

20. The foldable pouch of claim 19, wherein the at least one hook is coupled to the flexible loop by an intermediate flexible strap.

21. The foldable pouch of claim 1, which in the collapsed configuration with the cross-members removed from between the pair of flexible loops, the aligned pair of flexible loops are twistable to a figure-eight configuration and foldable over each other to assume a compact generally circular flat configuration.

* * * * *